US006716319B2

(12) United States Patent
Gale et al.

(10) Patent No.: US 6,716,319 B2
(45) Date of Patent: Apr. 6, 2004

(54) MOLDED PULP PRODUCT AND APPARATUS AND METHOD FOR PRODUCING THE SAME

(75) Inventors: Gregory W. Gale, Napa, CA (US); Jeffrey J. Haugen, Santa Rosa, CA (US); Edward D. Alloway, Dixon, CA (US); Eric A. Davis, Napa, CA (US)

(73) Assignee: Regale Corporation, Napa, CA (US)

( * ) Notice: Subject to any disclaimer, the term of this patent is extended or adjusted under 35 U.S.C. 154(b) by 41 days.

(21) Appl. No.: 09/955,761

(22) Filed: Sep. 18, 2001

(65) Prior Publication Data

US 2003/0051845 A1 Mar. 20, 2003

(51) Int. Cl.[7] ..... D21J 3/00

(52) U.S. Cl. ..... 162/391; 162/388; 162/218; 162/227; 162/228

(58) Field of Search ..... 162/228, 391, 162/218, 219, 221–224, 226, 227, 230, 231, 387–389, 392, 396, 399; 264/86, 87; 226/406, 407; 206/521.1; 220/659

(56) References Cited

U.S. PATENT DOCUMENTS

| | | | | | |
|---|---|---|---|---|---|
| 1,880,458 | A | * | 10/1932 | Morris | 162/192 |
| 2,326,758 | A | * | 8/1943 | Chaplin et al. | 162/219 |
| 2,471,932 | A | * | 5/1949 | Chaplin | 162/223 |
| 2,746,358 | A | * | 5/1956 | Emery | 162/392 |
| RE24,860 | E | * | 8/1960 | Kyle | 162/219 |
| 3,016,091 | A | * | 1/1962 | Daniele | 162/391 |
| 3,596,314 | A | | 8/1971 | Krugler | |
| 3,850,793 | A | * | 11/1974 | Hornbostel et al. | 162/391 |
| 5,356,518 | A | * | 10/1994 | Kelley et al. | 162/224 |
| 5,431,784 | A | | 7/1995 | Miyamoto et al. | |
| 5,603,808 | A | | 2/1997 | Nishikawa | |
| 5,656,135 | A | | 8/1997 | Baker | |
| 5,972,169 | A | * | 10/1999 | Bodary et al. | 162/218 |
| 5,976,457 | A | | 11/1999 | Amaya et al. | |
| 6,149,772 | A | | 11/2000 | Rasmussen | |
| 6,245,199 | B1 | * | 6/2001 | Lee | 162/385 |
| 6,287,428 | B1 | | 9/2001 | Gale et al. | |

OTHER PUBLICATIONS

"Advanced Rapid Prototyping and Manufacturing Solutions", pamphlet by DTM, 1998, 4 pages.

* cited by examiner

*Primary Examiner*—Steven P. Griffin
*Assistant Examiner*—Eric Hug
(74) *Attorney, Agent, or Firm*—Dorsey & Whitney LLP

(57) ABSTRACT

Apparatus for producing a molded pulp product from a fiber slurry comprising a dip tank containing a fiber slurry therein and having a liquid level. A platen is provided. A porous mold is carried by the platen. The platen and the mold carried thereby are lowered into the fiber slurry in a downward direction with the platen being disposed upwardly of the mold so that the mold is introduced through the liquid level into the fiber slurry. A vacuum is supplied to the platen and to the mold while the mold is disposed in the fiber slurry to cause fibers in the fiber slurry to collect onto the mold and form a wet molded pulp product. The platen and the mold with the wet molded product thereon are moved out of the fiber slurry through the liquid level to permit water to drain from the mold and the wet molded pulp product. The wet molded pulp product is then dried.

22 Claims, 10 Drawing Sheets

MOLDED PULP PRODUCT AND APPARATUS AND METHOD FOR PRODUCING THE SAME

This invention relates to a molded pulp product and apparatus and method for producing the same.

Molded pulp products have heretofore been produced including fine pulp products. Such fine pulp products have been produced in a press-to-dry procedure by progressively stepping a wet pulp part under pressure through a plurality of heated tools. The molded pulp product produced in such a procedure because of the pressure applied has a relatively smooth surface on one side which is smoother than the other. It has been found that such fine pulp products because they are made in this manner have an unnatural laying down of the fibers to create striations that appear like laminations which has been found to decrease the strength of a fine molded product and also to increase its brittleness. Such fine molded products also have surfaces which are rougher than the other surfaces and thus have unpredictable variable stacking pitches which affect the nesting and denesting capabilities. This differing roughnesses of the surfaces and the variable stacking pitches also make it difficult to de-nest the fine molded products. There is therefore a need for a new and improved molded pulp product which does not have these undesirable features and also a new and improved apparatus and method for producing the same.

In general, it is an object of the present invention to provide a molded pulp product having improved characteristics and an apparatus and method for producing the same.

Another object of the invention is to provide a molded pulp product which can be created with much tighter tolerances.

Another object of the invention is to provide a molded pulp product which has a predictable stacking pitch.

Another object of the invention is to provide a molded pulp product of the above character in which the stacking pitch can be reduced.

Another object of the invention is to provide a molded pulp product of the above character in which first and second surfaces of the molded product have opposing surfaces which are relatively smooth.

Another object of the invention is to provide a molded pulp product of the above character utilized from first and second mating molds having screens and in which the first and second surfaces emulate the screen patterns of the screens of the first and second molds.

Another object of the invention is to provide a molded product of the above character in which the surfaces of both sides are precisely controlled.

Another object of the invention is to provide an apparatus and method of the above character in which the mold is carried by a platen and in which the mold is introduced into the fiber slurry in an upside down positions and with the platen remaining dry.

Another object of the invention is to provide an apparatus and method of the above character after the wet molded product has been formed on the tool in which the platen and the mold are inverted to a right-side up position so that the platen underlies the mold.

Another object of the invention is to provide an apparatus and method of the above character which facilitates the drainage of water from the wet molded product carried by the mold.

Another object of the invention is to provide an apparatus and method of the above character in which the mold carrying the wet molded product is advanced into a heated atmosphere.

Another object of the invention is to provide an apparatus and method of the above character in which the mold is advanced into a mating mold in the drying chamber so that mold impressions are formed on first and second surfaces of the molded pulp product.

Additional objects and features of the invention will appear from the following description in which the preferred embodiments are set forth in detail in conjunction with the accompanying drawings.

DETIELED DESCRIPTION

Figure 1:
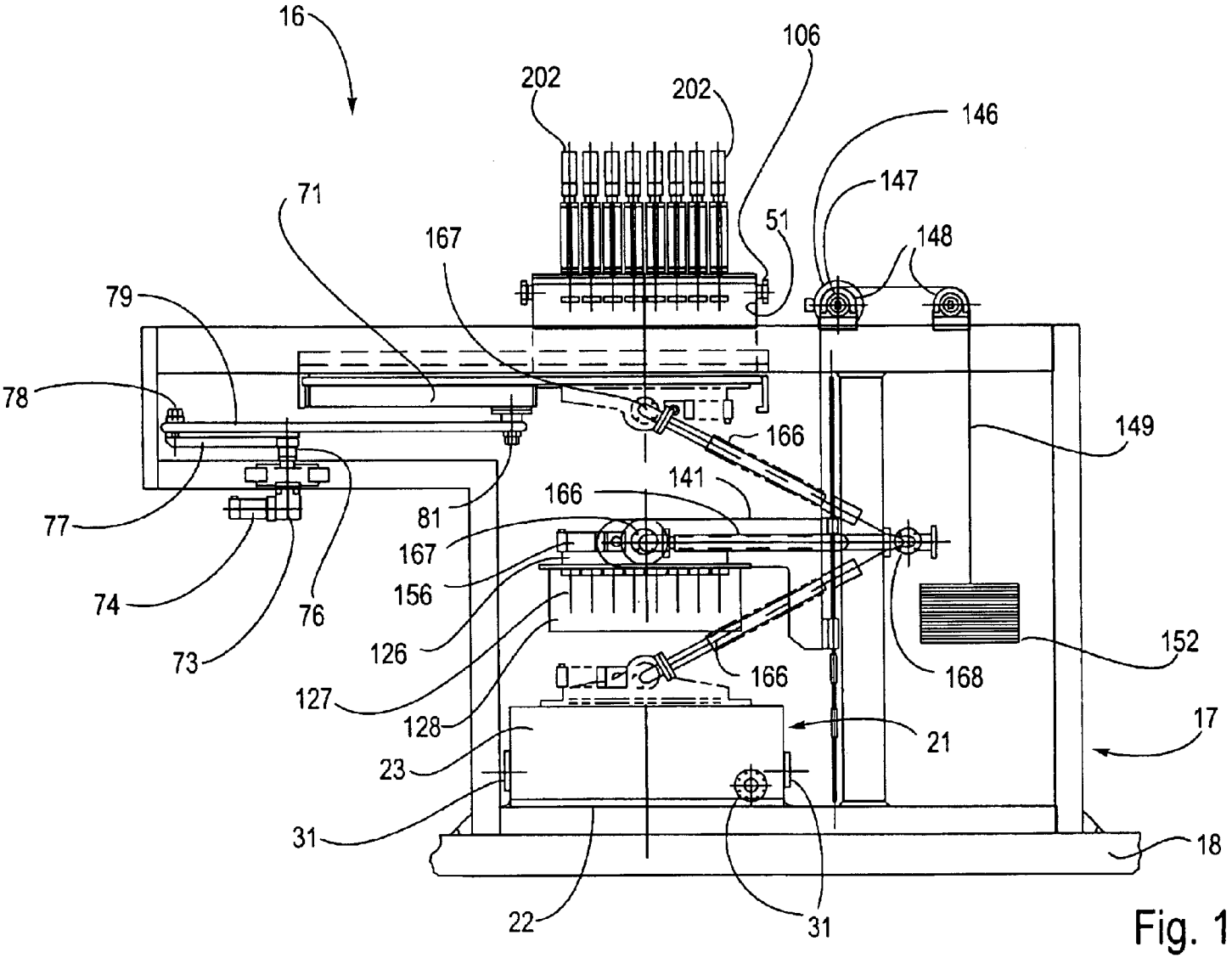
FIG. 1 is a side elevational view of an apparatus incorporating the present invention for producing molded pulp products of the present invention.
Figure 2:
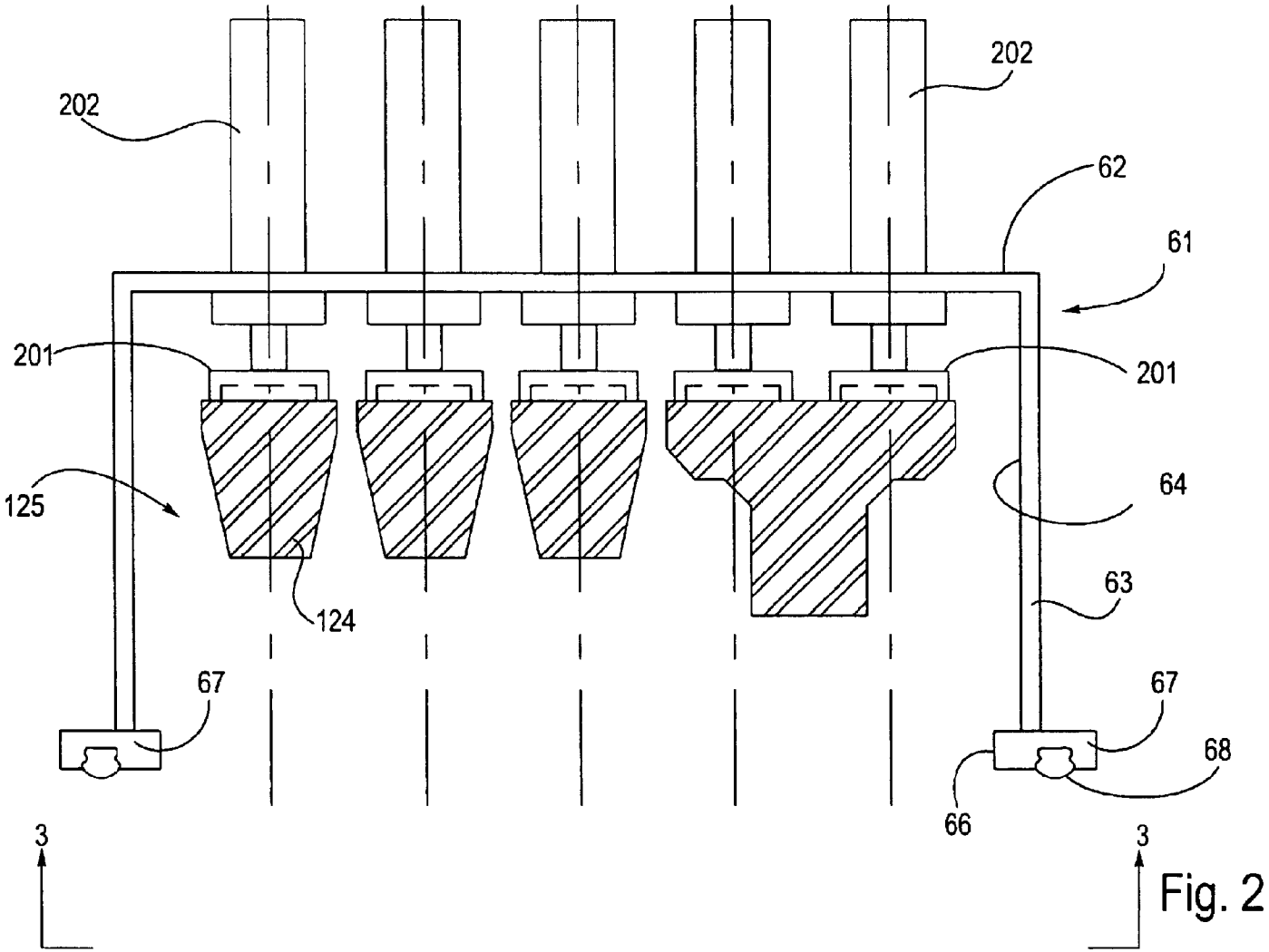
FIG. 2 is a side elevational view of the drying tank shown in FIG. 1.
Figure 3:
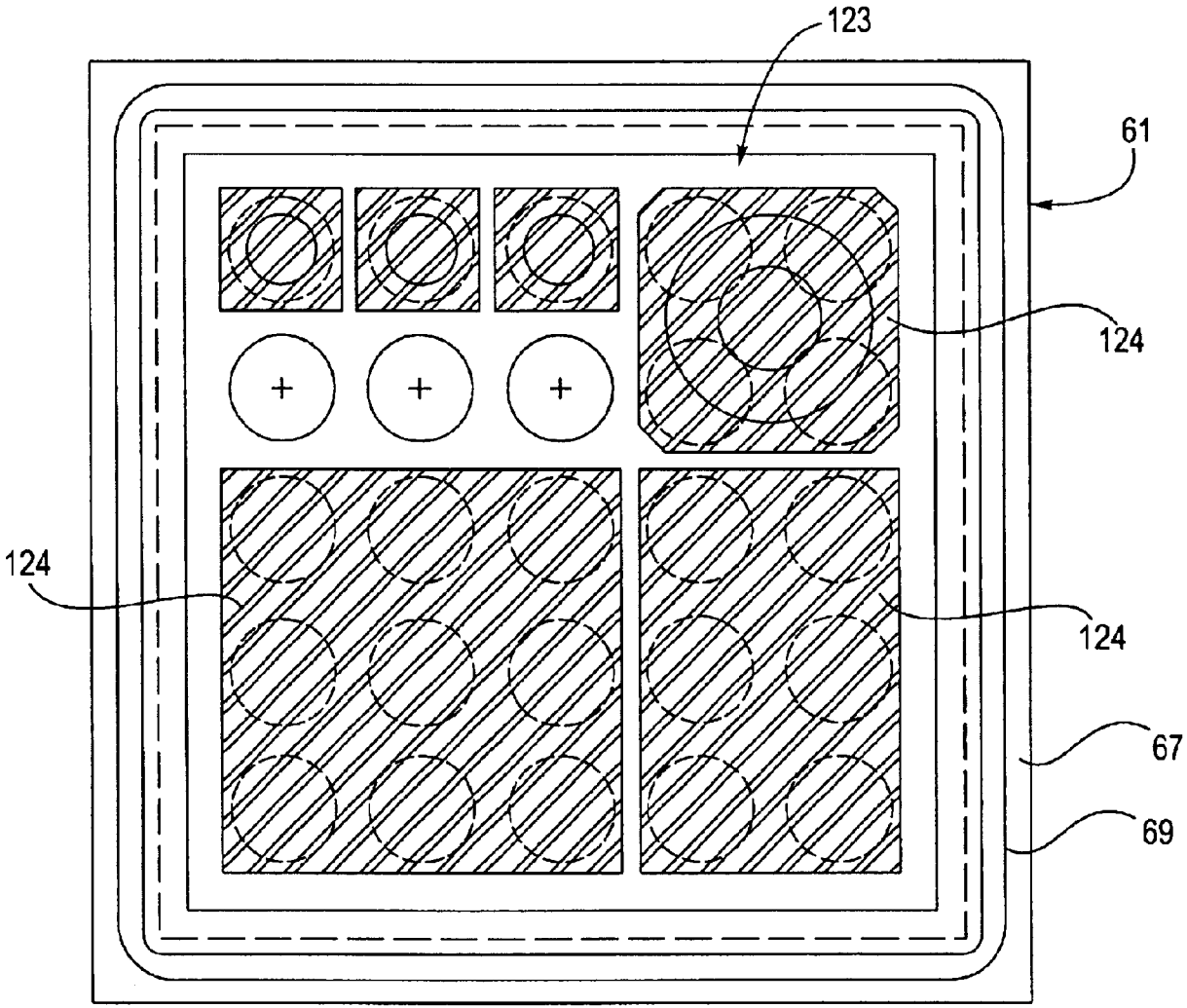
FIG. 3 is a view looking along the line 3—3 of FIG. 2.
Figure 4:
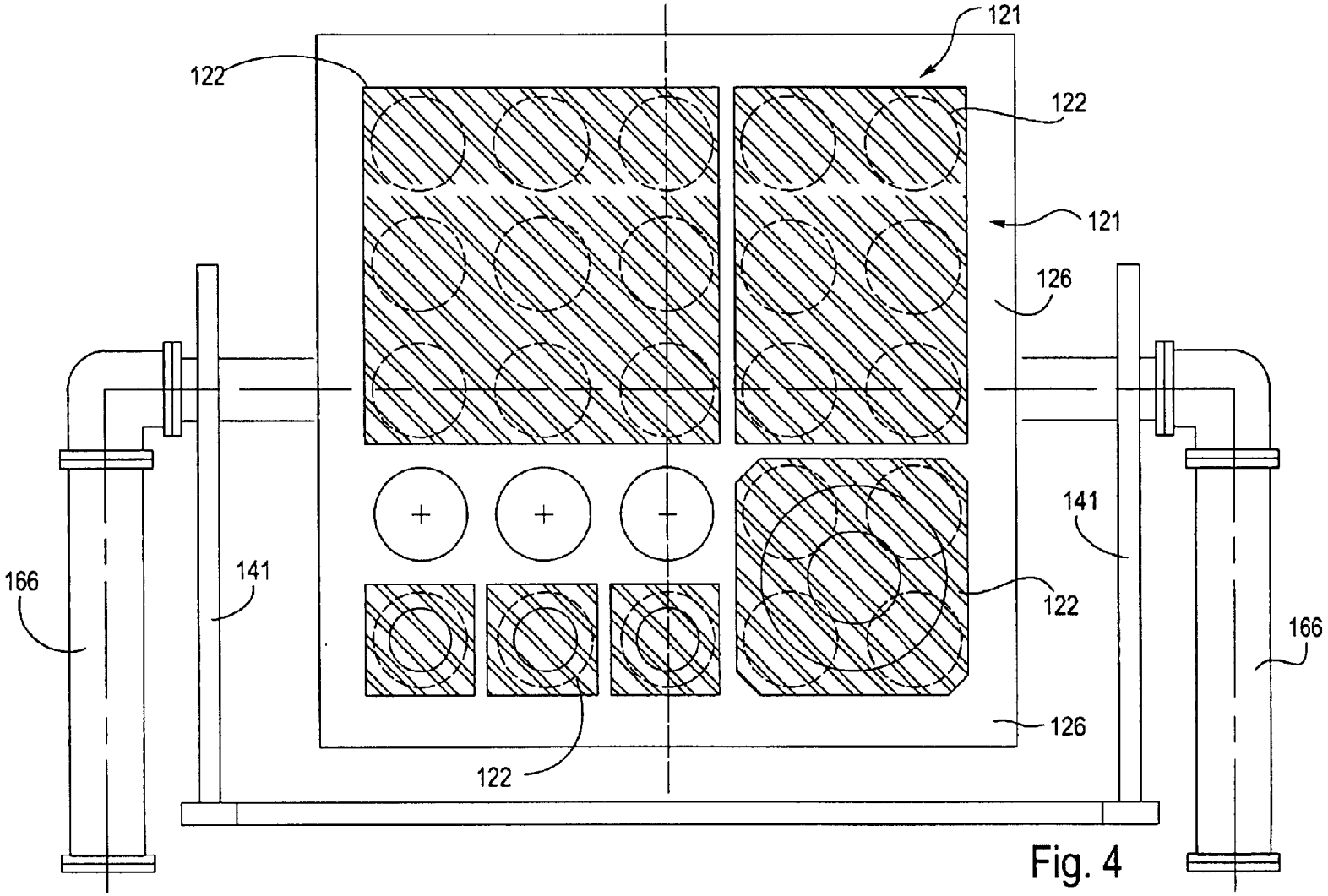
FIG. 4 is a view looking down onto the suction or mold platen from the drying tank.
Figure 5:
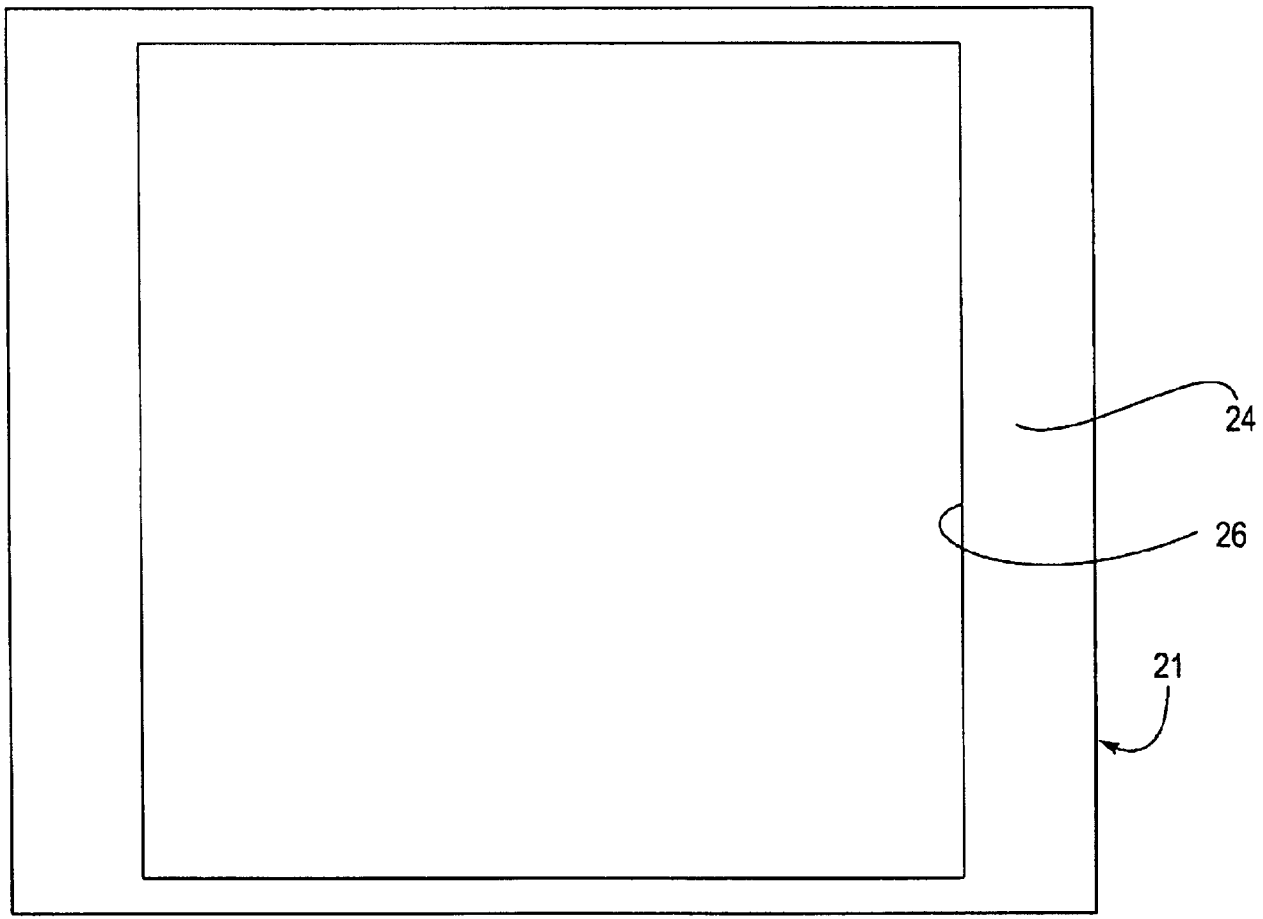
FIG. 5 is a top plan view of the slurry tank shown in FIG. 1.
Figure 6:
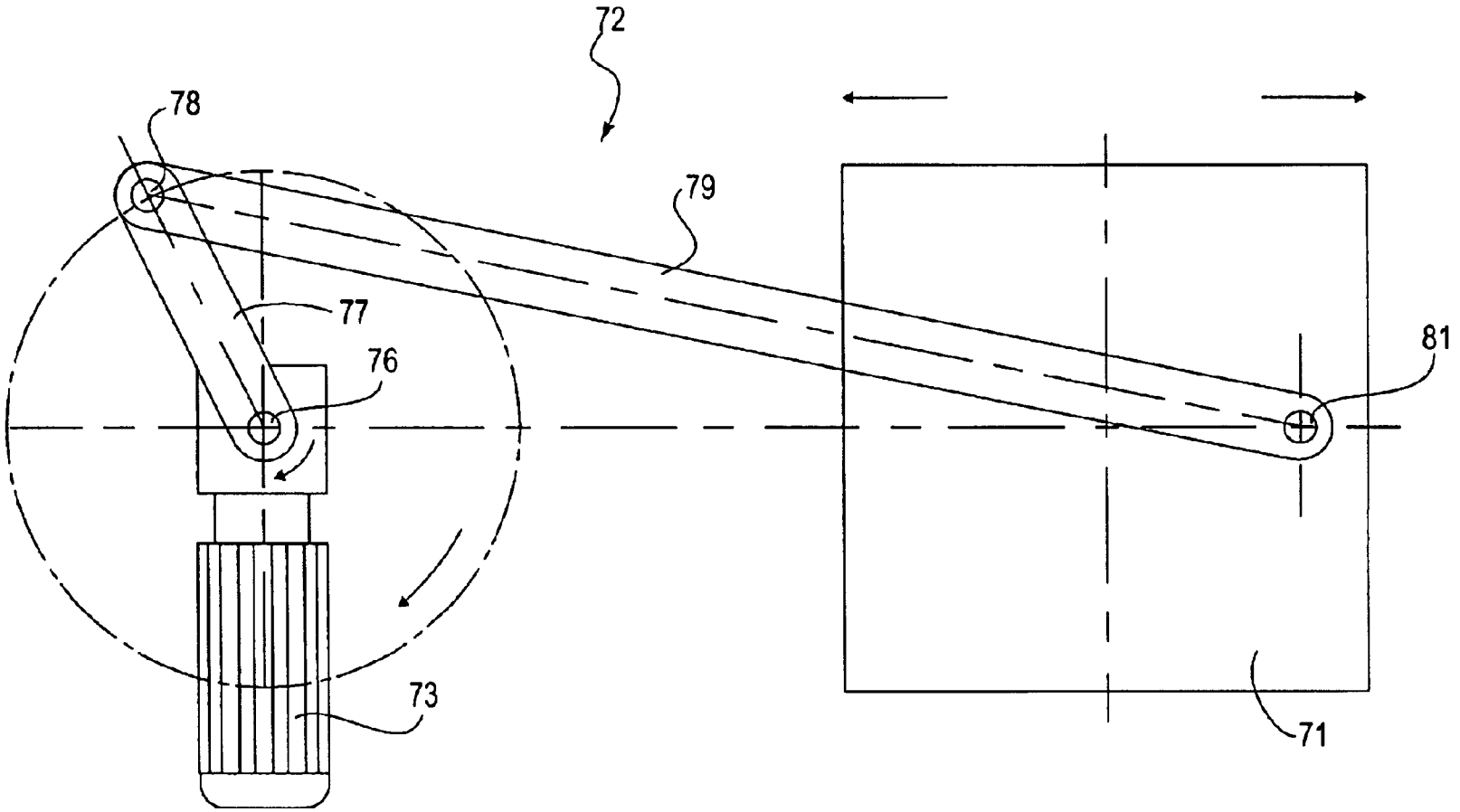
FIG. 6 is a bottom plan view of the closure platen and shows the mechanism for operating the same.

In general, the apparatus for producing a molded pulp product from a fiber slurry is comprised of a dip tank which contains a fiber slurry therein and having a liquid level. A platen is provided and a porous mold is carried by the platen. Means is provided for moving the platen and the porous mold carried thereby into a position so that the porous mold is upside down and moved downwardly through the liquid level into the fiber slurry. Means is provided for supplying a vacuum to the porous mold while the porous mold is disposed in the fiber slurry to cause fibers in the fiber slurry to collect onto the porous mold and form a wet molded product. Means is provided for moving the platen and the mold to move the mold out of the fiber slurry through the liquid level of the fiber slurry to permit water to drain from the wet molded product and the porous mold. Means is provided for drying of the wet molded product.

The apparatus 16 for producing a molded pulp product of the present invention as shown in FIGS. 1–9 consists of a framework 17 formed of a suitable material such as stainless steel. The framework 17 is resting upon raised floor 18.

A slurry dip tank 21 of a suitable material such as stainless steel is mounted in the bottom of the framework 17 and is of a suitable size as for example one containing approximately 1,000 gallons. The slurry dip tank 21 is provided with a bottom wall 22, upstanding side walls 23 and a top wall 24 overlying the bottom wall 22 and parallel to the bottom wall. The top wall 24 is provided with a rectangular opening 26 in the form of a square giving access to the parallelepipedshaped chamber 27 provided within the tank 21. The tank 21 is provided with a plurality of flanged couplings 31, shown schematically in FIG. 9. Thus, there is provided an inlet coupling 33 which is connected through a pump 34 to a pulp storage tank 36. Means is provided for recirculating the pulp slurry introduced into the slurry dip tank 21 and consists of a recirculating pump 41 which is connected to the dip tank 21 through a coupling 42 through a valve 43 for withdrawing slurry from the tank 21 and supplying it through another valve 44 through a densitometer 46 through a coupling 47 into the tank 21. The coupling 47 is connected to another coupling 48 within the chamber 27 of the tank 21 and is connected to piping 49 which has mounted thereon a plurality of spaced-apart jets 51 for re-introducing slurry into the slurry dip tank 21 and for agitating the slurry in the tank 21 so that it has a uniform consistency extending throughout the slurry dip tank 21 as measured by a consistency meter (not shown).

Means is provided for controlling the temperature of the slurry within the dip tank 21 and consists of electrical heaters 56 mounted in the side walls of the tank which are thermostatically controlled to maintain the slurry within the dip tank at a predetermined temperature.

A dry tank 61 formed of a suitable material such as stainless steel is mounted in the upper part of the framework 17 and includes a top wall 62 and downwardly extending side walls 63 to form a dry chamber 64 which is in the form of a parallelepiped that is accessible through a bottom side opening 66. The lowermost extremities of the side walls 63 have secured thereto a seal member 67 which has a recess 68 provided in the lower side thereof which has received therein an inflatable seal 69.

The bottom side opening 66 of the dry tank 61 is adapted to be closed by a closure platen 71 of stainless steel which is movable on rails of the framework 17 between a closed position closing said bottom side opening 66 and an open position in which it is out of the way from the bottom side opening 66. Means is provided for moving the closure platen 71 between the closed and open positions in the form of a crank mechanism 72 which consists of a gear motor 73. The gear reducer is provided with an output shaft 76 which drives a crank arm 77. The crank arm is pivotably connected by a pin 78 to a connecting rod 79 which is pivotably connected to the closure platen 71 by a pin 81 (see FIG. 5). By this crank mechanism 72 it can be seen that the closure platen 71 is moved linearly between open and closed positions with respect to the bottom side opening 66.

Means is provided for supplying air under pressure for inflating and deflating the inflatable seal 69 so that an air-tight seal can be formed between the dry tank 61 and the closure platen 71 and consists of a compressor 82 open to atmosphere through a valve 83 and in communication with a tank 84 through a valve 85. The compressed air from the tank 84 is supplied through a flanged coupling 86, through a control valve 87, a filter 88 and a regulator 89 to instrument air piping 91. This instrument air is supplied from the piping 91 through a reducer 92 through a valve 93 and through a solenoid controlled valve 94 through a regulator 96 and then through a quick exhaust valve 97 to the inflatable seal 69. From these controls it can be readily seen that the seal member 69 can be inflated by operation of the solenoid valve 94 and deflated by operation of the quick exhaust valve 97.

Means is provided for supplying heated air to the dry chamber 64 and consists of a compressor 101 connected to atmosphere through a valve 102 and connected to an air receiver tank 103 through a valve 104 to provide compressed air at a suitable pressure such as 60 psi. The tank 103 is coupled through a flanged coupling 106 to piping 107. The piping 107 is connected through a control valve 108 to an air heater 109 of a suitable type as for example one having a capacity of 192 kW of electrical heat for heating the air and supplying the heated air through a valve 111 reducers 112 connected into jets 113 connected through the side walls 63 of the dry tank 61 for supplying heated air to the dry chamber 64. If desired the heater 109 can be bypassed through a bypass valve 116.

In connection with utilizing the apparatus 16 for producing molded pulp products, a first set 121 of mating porous molds is provided which is comprised of a plurality of first mating porous molds 122 that may be alike or which at the choice of the operator of the apparatus may be of different sizes and shapes. The porous molds 122 can be of the type described in copending application Ser. No. 09/385,914 filed Aug. 30, 1999. A second set 123 of mating porous molds of the same type is provided for mating with the first set of mating molds and also includes a plurality of second mating porous molds 124 which form pairs with the first mating molds 122.

The apparatus 16 includes means for mounting the first set 121 of mating molds 122 and consists of a mold platen 126 which has mounted thereon a plurality of inflatable mold holders 127. The mold holders 127 are supplied with mold holder air from the instrument air piping 91 through a reducer 128 through a solenoid operated valve 129 through a regulator 131 to supply 50 psi air through a quick exhaust valve 132 through another reducer 133 to the mold holders 127. Thus it can be seen by the use of the solenoid operated valve 129, molds 122 can be secured to the mold platen 126 and upon release of the mold holder air through the quick exhaust valve 132, the molds 122 can be removed.

Means is provided for supporting the mold platen 126 and for moving the mold platen 126 between an intermediate position, a dip tank position and a dry tank position and consists of spaced-apart cantilevered support arms 141 mounted on linear sleeve bearings 142 which are mounted for vertical sliding movement on cylindrical posts 143 forming a part of the framework 17. Means is provided for moving the sleeve bearings 142 and the cantilevered arms 141 carried thereby vertically between the intermediate position, dip tank position and the dry chamber position and consists of a gear motor 146 which has an output shaft 147 that drives a sheave 148. The drive sheave 148 drives a cable 149, one end of which is secured to the cantilevered arms 141 and that travels over another sheave 151 mounted on the framework 17 as shown in FIG. 1 and has the other end attached to a counterweight 152. By operation of the gear motor 156 it can be seen that the mold platen 126 carried by the cantilevered arms 141 can be readily moved between the intermediate, dip tank and dry tank positions.

Means is provided for rotating the mold platen 126 through at least 180° for a purpose hereinafter described and consists of a right angle gear motor 156 secured between the cantilevered arms 141 and the mold platen 126 so that the mold platen can be rotated 180° from the position shown in FIG. 1 in which the molds 122 are upside down and facing downwardly and to a position that the molds are facing upwardly. Thus it can be seen that it is possible to move the mold or suction platen 126 from a mold downwardly facing position to a mold upwardly facing position for a purpose hereinafter described.

Figure 9:
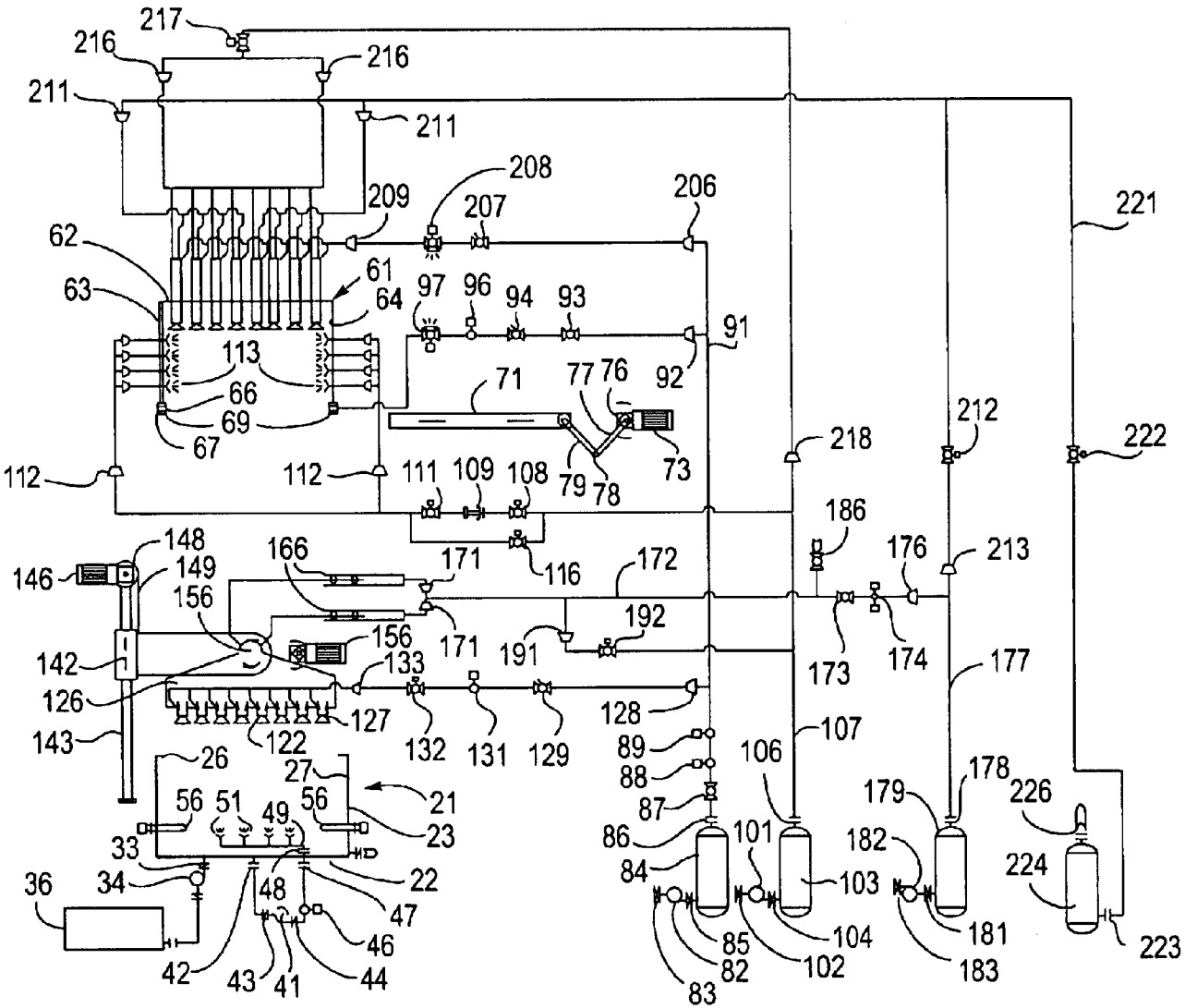
FIG. 9 is a schematic flow diagram of the apparatus shown in FIG. 1.

A telescoping tubular assembly 166 is provided on opposite sides of the mold platen 126 with one end being connected to a flanged connection 167 and the other end being connected to a pivoted flanged connection 168 to permit movement of the mold platen between the dip tank and dry tank positions. As shown in FIG. 9, these telescoping tubular assemblies 166 are connected through reducers 171 to a line 172. The line 172 is connected through a valve 173 which can be moved between open and closed positions and connected through a vacuum regulator 174 through another reducer 176 which is connected to a vacuum line 177. The vacuum line is connected through a flanged coupling 178 to a vacuum receiver buffer tank 179. The tank 179 is connected through a valve 181 to a vacuum pump 182 that is connected to atmosphere through a valve 183. The line 172 is also adapted to be placed in communication with the atmosphere through a valve 186 movable between open and closed positions. Compressed air may also be supplied to the line 172 for blowing off molded products as hereinafter described from the compressed air line 107 supplied through a reducer 191 and through a product blow off valve 192 regulated to 10 psi.

The second mating molds 124 of the second set 123 of mating molds are positioned within the dry chamber 64 and are adapted to be releasably secured to mold holders 201 carried by robotic cylinders 202 mounted in the top wall 62 of the dry tank 61. These robotic cylinders 202 are of a conventional type and are stepper motor actuated so that the positioning of the second mating molds can be precisely adjusted during the molding processes as hereinafter described. Mold holder air is supplied from piping 91 to each of the robotic cylinders 202 through a reducer 206 which is connected through a quick exhaust valve 208 to a solenoid operated valve 207 and through another reducer 209. The robotic cylinders 202 are also connected to a source of vacuum through, reducers 211, a control valve 212 and another reducer 213 to the vacuum line 177. Also the robotic cylinders 202 are connected through reducers 216 to the compressed air piping 107 through a control valve 217 and a reducer 218.

An atmosphere line 221 is connected to the vacuum line 177 which can be opened to the atmosphere through a control valve 222 through a flanged connection 223 mounted on an atmosphere vent tank 224. The atmosphere vent tank 224 can be vented to atmosphere through a flanged coupling 226.

Figure 10:
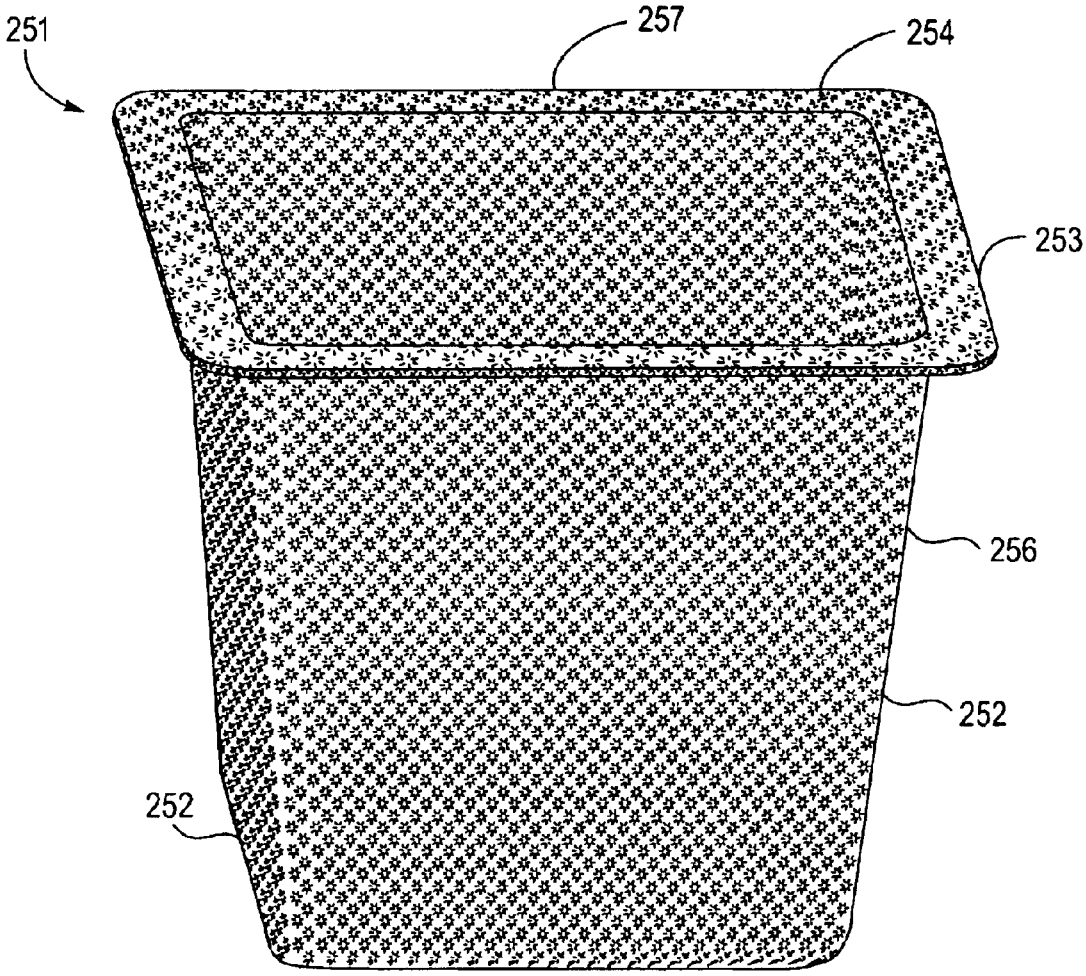
FIG. 10 is an isometric view of a molded pulp product incorporating the present invention and made with the apparatus and method of the present invention.

A molded pulp product made with the apparatus and method of the present invention is shown in FIG. 10. This molded pulp product 251 is merely representative of the many various types of products which can be produced in accordance with the present invention. Thus a molded pulp product 251 which is in the form of a container is provided with a bottom wall (not shown) and upstanding side walls 252 which are inclined upwardly and outwardly from the bottom wall and which adjoin a horizontally extending rim 253 at their uppermost extremities, defining a space 254 for receiving articles or other materials. The bottom wall (not shown) and the side walls 252 and the rim 253 are all provided with first and second exposed surfaces 256 and 257 that are parallel and spaced apart by a distance corresponding to the thickness of the walls. Both of the first and second exposed surfaces 256 and 257 are relatively smooth but have a texture which mirrors the screen pattern of the first and second mating porous molds hereinbefore described. The thickness of the walls forming the molded pulp product container 251 can be precisely controlled which also makes it possible to control the pitch of the side walls 252 so that a predetermined predictable stacking pitch can be provided on the containers so that they can be readily nested and de-nested. Also because of the predictable stackabilities, it is possible to ship more product in a truckload as for example from 5 to 10% more product than that which can be achieved with conventional molded pulp products.

Operation and use of the apparatus and method for producing molded pulp products incorporating the present invention may now be briefly described as follows. Let it be assumed that a plurality of molds or tools of the type desired have been fabricated in the manner described in U.S. Pat. No. 6,287,428. Let it be assumed in connection with the particular procedure or method hereinafter described that it is desired to utilize a plurality of porous mating molds which are of different sizes and shapes to make possible the production of a plurality of different types of molded products during a single production sequence. Thus, there have been provided first mating molds 122 of different sizes and configurations as shown in the drawings and a plurality of second mating molds 124 corresponding to the sizes and configurations of the first mating molds 122 to thereby provide first and second sets of mating molds 121 and 123 forming a plurality of pairs of mating molds. These first mating molds 122 are secured to the mold platen 126 by use of the conventional mold holders 127 carried by the mold or suction platen 126 and operated by the use of mold holder air. The platen 126 suction or mold serves as a manifold and can be of the type described in U.S. Pat. No. 6,287,428 which is in communication with the molds 122 through the mold holders 127. The second mating molds 124 are secured to the mold holders 201 by mold holder air and are carried by the positioner or robotic cylinders 202.

After the first and second sets of mating molds 121 and 123 are in place, the apparatus 16 as shown in the drawings can be placed in operation. Let it be assumed that the slurry dip tank 21 has been filled to an appropriate liquid level with a pulp slurry from the pulp storage tank 36. The pulp slurry is continuously recirculated by use of the circulating pump 41 to provide a pulp slurry which has a uniform consistency throughout the dip tank 21. Let it also be assumed that the slurry in the dip tank is maintained at a predetermined temperature as for example a room temperature of 25° C. or 70° F.

Let it be assumed that the mold platen 126 is in an intermediate position shown in FIG. 1 between the slurry dip tank 21 and the dry tank 61 and that the first set of mating molds 121 has been mounted as hereinbefore described are facing downwardly or are in an upside down position. The gear motor 146 is operated to lower the mold platen 126 downwardly so that the first mating molds 122 carried by the platen 126 are moved downwardly into the opening 26 of the dip tank 21 and penetrate the liquid level of the pulp slurry in the dip tank to a depth so that only the molds are immersed in the slurry while the mold platen 126 remains above the liquid level of the slurry and remains dry.

As soon as the first mating molds 122 enter the slurry in the dip tank a vacuum is applied from the vacuum line 177 through the telescoping assembly 166 to the mold or suction platen 126. Typically the vacuum can correspond to approximately 7 inches of mercury which is continued to be applied until a sufficient amount of fibers have been collected on the first mating molds 122 to provide wet molded products on the molds. Power is again supplied to the gear motor 146 to lift the mold platen 126 out of the slurry. As this lifting of the molds commences, the vacuum supplied to the molds is increased, as for example to as much as 12 to 13 inches of mercury. As this lifting is occurring, the fibers which are not adhering to the mold will be wiped away by the draining liquid slurry back into the dip tank 21. Also excess water drains from the molds and the wet molded products into the dip tank 21.

After the mold or suction platen 126 has been raised to an approximately midway position between the dip tank 21 and the dry tank 61, the right angle gear motor 156 is operated to cause the mold or suction platen 126 to be rotated through 180° so that the first mating molds 122 carried thereby are moved from an upside down position to an upright or right side up position in which the force of gravity aids the draining of water from the wet molded products carried by the first mating molds 122. At this same time, the vacuum supplied to the mold platen is substantially increased as for example to 27 to 28 inches of mercury to aid in withdrawing substantially all of the water from the wet molded products carried by the molds. In accordance with the method of the present invention it is advantageous to pull out as much water as possible from the molded products carried by the molds to decrease the moisture which thereafter has to be evaporated in the dry chamber 64 of the dry tank 61. The water which is collected by the vacuum applied to the wet molded products carried by the first mating molds 122 can be collected for a first period of time as for example 5 seconds and reused in making additional pulp slurry after which the air and any remaining moisture which is withdrawn can be vented to the atmosphere through the valve 186 for another predetermined period of time as for example 15 seconds for a total cycle time of 20 seconds.

Figure 7:
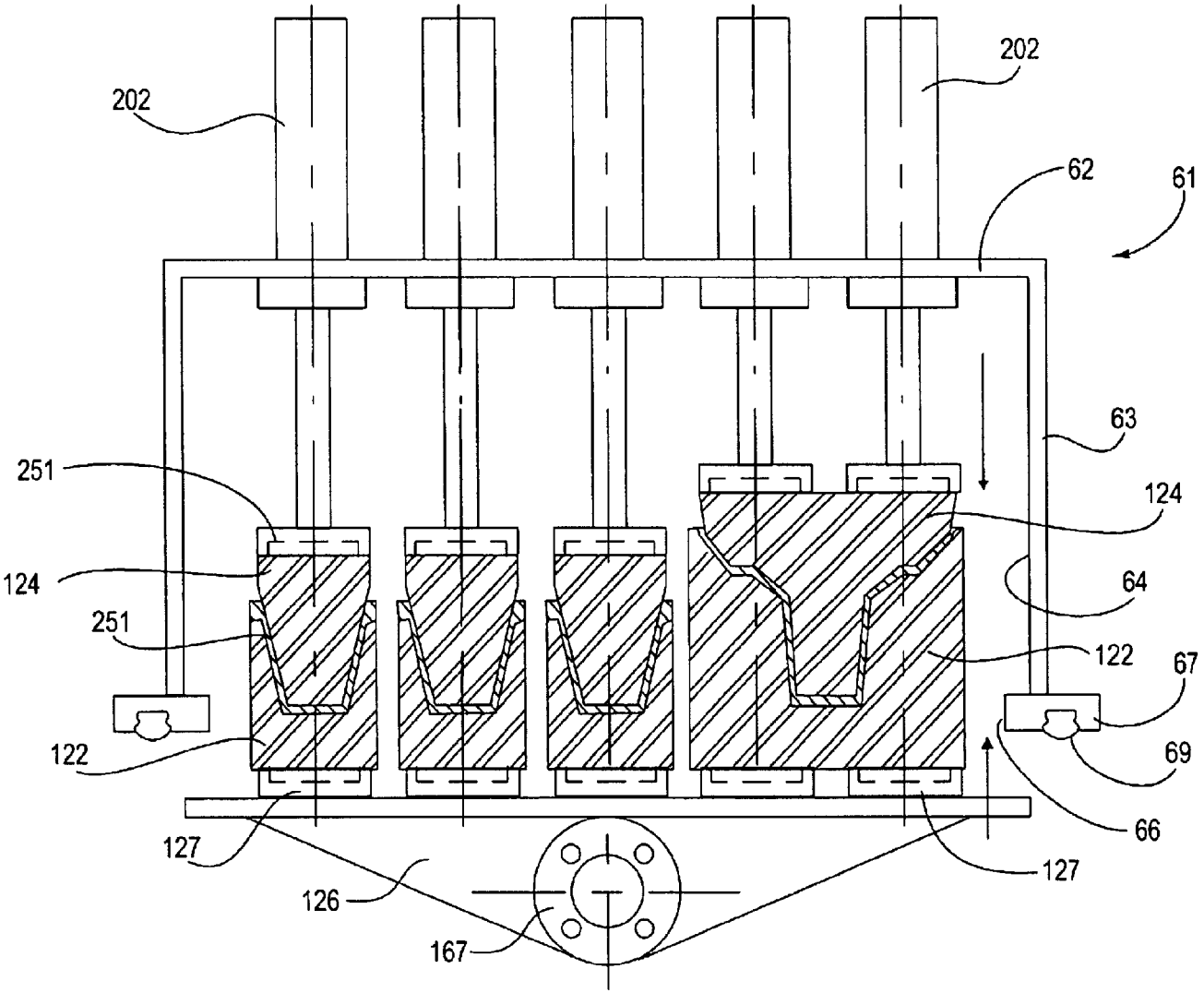
FIG. 7 is a side elevational view in cross section of the dry tank with the suction platen being moved into place into the dry tank.
Figure 8:
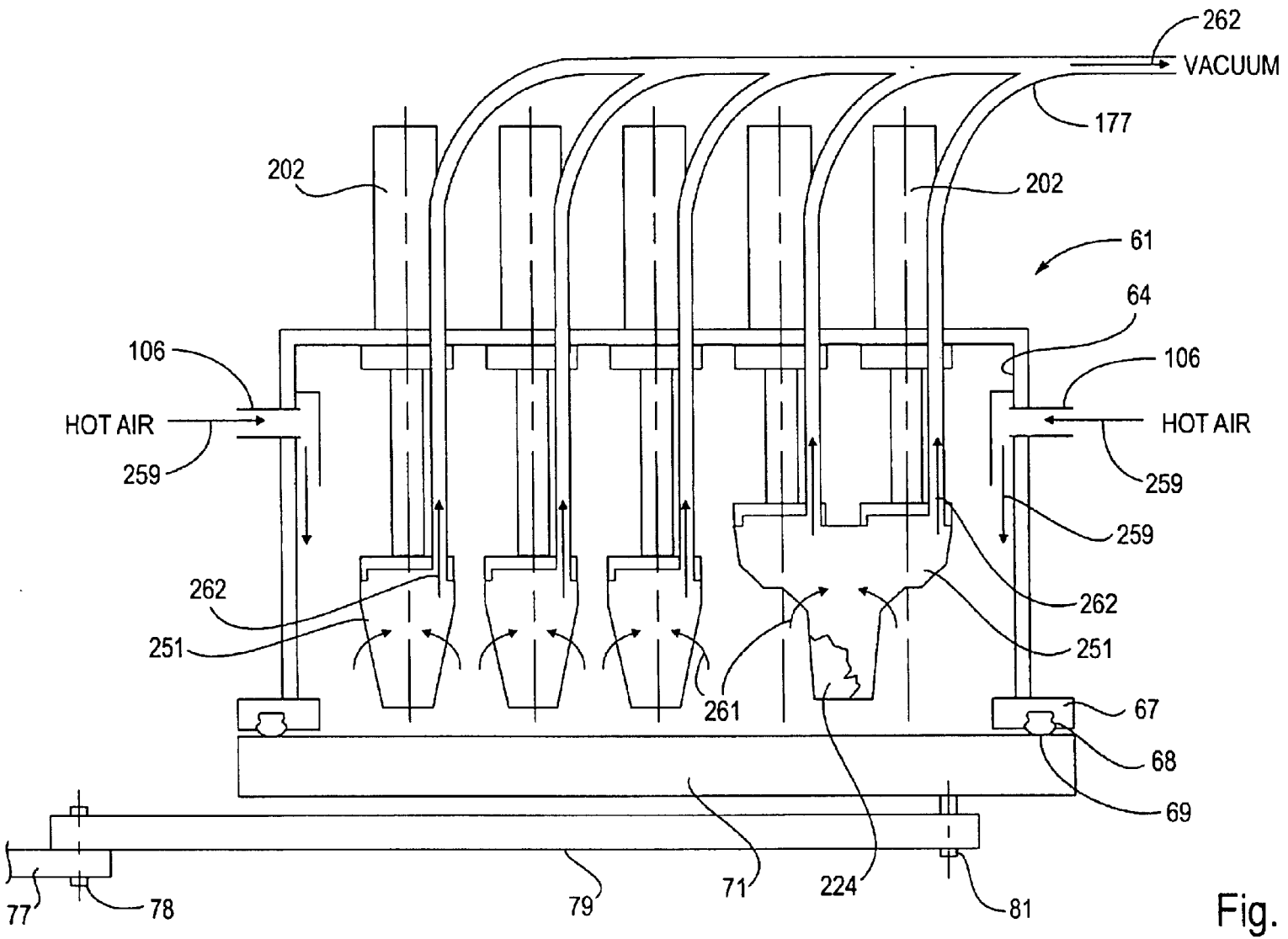
FIG. 8 is a side elevational view in cross section of the dry tank with the closure platen in place and showing the application of hot air and vacuum to the dry tank.

As this withdrawal of water is being accomplished from the wet molded products carried by the first mating molds 122, the mold platen 126 continues to move upwardly into the dry chamber into a position such as shown in FIG. 7. After or during the time that is occurring, the positioner or robotic cylinders 202 are operated to bring the second mating molds 124 downwardly into engagement with the first mating molds 122 as shown in FIG. 8 to create a partially dried molded product 251 that is self supporting which has a precise predetermined wall thickness because of the close tolerances made permissible by the operation of the positioner cylinders 202 and the positioning of the suction or mold platen 126.

As soon as this positioning of the first mating molds 122 and the second mating molds 124 has occurred, a vacuum is applied to the mold holders 201 and shortly thereafter or at the same time, a short burst of air under pressure under the control of product blow off valve 192 is supplied to the mold holders 127 to blow the molded pulp products off of the molds 122. As this is occurring, the positioner or robotic cylinders 202 are actuated to raise the second mating molds 124 and to carry with them the molded pulp products 251 upwardly into the dry chamber 64 of the dry tank 61. As this is occurring, the mold or suction platen 126 is lowered out of the drying chamber 64 by operation of the gear motor 146.

As soon as the first mating molds 122 have cleared the lower extremity of the dry tank 61, the bottom side opening 66 of the dry tank 61 is closed by operating the gear motor 73 to move the closure platen 71 from an out-of-the-way position into a closed position in which it underlies the lower extremity of the dry tank 61. The inflatable seal 69 is then inflated by operation of the solenoid operated valve 94 to provide an air-tight seal between the dry chamber 64 and the closure platen 71. As soon as the dry chamber 64 has been sealed, hot compressed air at a pressure ranging from 30 to 40 psi at approximately 300° F. is supplied from the heater 104 to the dry chamber 64 as shown by arrows 259. The hot air after it enters the dry chamber 64 can only escape by passing through the molded pulp products and the porous molds 122 as shown by arrows 261 thence through the vacuum line 177 as shown by arrows 262. Alternatively, the hot air after passing through the porous molds can be vented to the atmosphere. Because all of the heated air to escape must pass through the molded fiber products, a highly efficient drying of the molded pulp products occurs.

The drying operation is facilitated because it is unnecessary to dry the mold platen 126 because it always remains dry. As hereinbefore explained, care is taken so that the mold platen is not dipped into the fiber slurry in the dip tank 21 and therefore remains dry. Even when the mold platen 126 is rotated through 180° and inverted so that the molded pulp products are above the platen, the moisture carried by the molded pulp products is drawn off through the vacuum lines connected to the mold or suction platen.

During this drying operation in the dry chamber 64, the mold platen 126 is being moved downwardly toward the dip tank 21. As this is occurring, the mold platen is rotated through 180° by operation of the gear motor 156 to cause the first mating molds 122 to again face downwardly after which they are again lowered down into the pulp slurry in the dip tank 21 as hereinbefore described and a vacuum is applied to form on the molds 122 additional wet molded pulp products 251 onto the molds 122.

After the molded pulp products have been sufficiently dried within the dry chamber 64, as for example having a moisture content of 5% or less, the seal inflation air on the inflatable seal 69 is quickly exhausted through the exhaust valve 97. Prior to or during this time, the heated air supplied from the heater 103 is terminated. The closure gear motor 73 is operated to move the closure platen 71 to an open out-of-the-way position to clear the opening 66.

After the molded pulp products have been dried to the desired dryness, they can be ejected from the second mating molds 124 by supplying compressed air to the cylinders 202 to cause the molded pulp products to drop downwardly through the opening 66 in the dry chamber 64 onto a suitable takeaway conveyor (not shown) which can be advanced and retracted in a timely manner so it underlies the dry chamber opening 66 and then is moved to an out-of-the-way position to permit the mold platen 126 to again enter the dry chamber 64 after the mold platen has been rotated through 180° to continue with the procedure hereinbefore described.

From the foregoing it can be seen that the apparatus of the present invention makes possible a method for producing molded pulp products which is very efficient. By making a transfer of the molded pulp products from the first mating molds 122 to the second mating molds 124, the final drying can be accomplished within the dry chamber 74 while the first mating molds are again being lowered into the dip tank 21 for the formation of the next set of molded pulp products. With such a procedure, the molded pulp products can be produced at a very rapid rate. The molded pulp products produced with the apparatus and method of the present invention produces a molded pulp product such as that shown in FIG. 10 which has many desirable qualities as hereinbefore described.

In the event all of these desirable qualities are not desired, it is possible to utilize the apparatus and method to produce a molded fiber product with only a single mold. This can be accomplished by utilizing a single mold carried by the mold platen 126 which can be dipped into the slurry dip tank 21 in the manner hereinbefore described and then raised out of the dip tank and rotated 180° from an upside down position to an upright position during which time a vacuum is being supplied to the molded pulp product. By utilizing such a method it is possible to dry the molded pump product sufficiently so that it can be transferred from the mold by supplying a puff of pressurized air to dislodge the molded product from the mold carried by the platen and transferring the molded product or products to a takeaway or transfer conveyor after which the product can be permitted to dry naturally in the open air or if desired can be supplied to a dry chamber remote from the apparatus. In this way it can be seen that a molded pulp product can be made with a single mold. However in this case, the molded pulp product would only have one surface that would have the screen pattern of the mold.

What is claimed:

1. Apparatus for producing a molded pulp product from a fiber slurry comprising a dip tank containing a fiber slurry therein and having a liquid level, a platen, a porous mold carried by the platen, means for moving the platen and the mold carried thereby into the fiber slurry in a downward direction with the platen being disposed upwardly of the mold so that the mold is introduced through the liquid level into the fiber slurry while retaining the platen so that it is not immersed in the fiber slurry, means for supplying a vacuum to the platen and to the mold while the mold is disposed in the fiber slurry to cause fibers in the fiber slurry to collect onto the mold to form a wet molded pulp product, means for moving the platen and the mold to move the mold upwardly out of the fiber slurry through the liquid level to permit water to drain from the mold and the wet pulp molded product and means for causing the wet molded pulp product to dry.

2. Apparatus as in claim 1 further including means for inverting the platen and the mold through 180° about an axis in close proximity to the platen after the mold has been removed from the fiber slurry so that the mold is facing upwardly with respect to the platen to facilitate the drainage of water from the mold and the wet molded pulp product.

3. Apparatus as in claim 1 further including a dry chamber and means for advancing the wet molded pulp product into the dry chamber and means for supplying heated air to the dry chamber to facilitate drying of the wet molded pulp product.

4. Apparatus as in claim 3 further including means for supplying a vacuum to the wet molded product while the molded product is in the drying chamber.

5. Apparatus as in claim 3 further including a framework, said dip tank being disposed in the framework and having an upwardly facing opening therein, a dry tank supported by the framework and overlying the opening in the dip tank and having a downwardly facing opening therein, means disposed in the framework for moving the platen between first, second and third positions, said first position being an intermediate position, said second position being a position overlying the opening in the dip tank and the third position being a position underlying the opening in the dry tank.

6. Apparatus for producing a molded pulp product from a fiber slurry comprising a dip tank containing a fiber slurry therein and having a liquid level, a platen, a porous mold carried by the platen, means for moving the platen and the mold carried thereby into the fiber slurry in a downward direction with the platen being disposed upwardly of the mold so that the mold is introduced through the liquid level into the fiber slurry, means for supplying a vacuum to the platen and to the mold while the mold is disposed in the fiber slurry to cause fibers in the fiber slurry to collect onto the mold to form a wet molded pulp product, means for moving the platen and the mold to move the mold upwardly out of the fiber slurry through the liquid level to permit water to drain from the mold and the wet pulp molded product, a dry chamber and a means for advancing the wet molded pulp product into the dry chamber and means for supplying heated air to the dry chamber to facilitate drying of the wet molded pulp product, said mold being a first mating mold and the apparatus further comprising a second mating mold capable of being disposed in the dry chamber and means for causing relative movement between the first mating mold and the second mating mold for causing the wet molded product to be formed with impressions from both the first and second mating molds, means for causing the wet molded product to be transferred to the second mating mold and to be carried by the second mating mold into the drying chamber, means forming an air-tight seal for the drying chamber after the wet molded product has been transferred into the drying chamber and means for supplying heated air to the dry chamber and to the wet molded product.

7. Apparatus as in claim 6 wherein the drying chamber is formed so that the heated air must pass through the molded product before the heated air can exit from the drying chamber.

8. Apparatus as in claim 6 further including means disposed in the dry chamber and engaging the second mating mold in the drying chamber for moving the second mating mold into engagement with the first mating mold carried by the platen when the platen is in the third position and means supplying a vacuum to the second mating mold to cause the wet molded pulp product to be transferred from the first mating mold to the second mating mold.

9. Apparatus as in claim 8 further including means for moving the second mating mold with the wet molded pulp product thereon into the dry tank and wherein said means for covering the opening in the dry tank to form an air-tight seal for the dry tank includes a closure platen, including means for controlling the movement of the closure platen into and out of engagement with the opening in the dry tank.

10. Apparatus as in claim 9 further including means for forming an air-tight seal between the drying tank and the closure platen when the closure platen has been moved to the closed position.

11. Apparatus as in claim 10 further including means for venting the heated air.

12. Apparatus as in claim 6 wherein the molded platen is constructed to carry a plurality of first mating molds and wherein a plurality of second mating molds are provided which are capable of being disposed in the drying chamber and wherein said means for causing relative movement between the first mating mold and the second mating mold includes means for causing relative movement of said plurality of first and said plurality of second mating molds which is capable of accommodating first and second mating molds of different sizes and configurations.

13. A method for producing molded pulp products from a fiber slurry having a liquid level with the use of a porous mold carried by a platen comprising introducing the mold downwardly with the platen being disposed upwardly of the mold into the fiber slurry through the liquid level of the fiber slurry so that the mold is immersed in the fiber slurry and having the platen free of the fiber slurry, supplying a vacuum to the mold to cause fibers from the fiber slurry to collect on the mold to form a wet molded pulp product, withdrawing the mold from the fiber slurry through the liquid level of the fiber slurry, permitting water to drain from the mold and the wet molded pulp product and drying the molded pulp product so that it is self-supporting and separating the molded product from the mold.

14. A method as in claim 13 wherein after the mold is withdrawn from the fiber slurry, the platen and the mold are inverted through 180° about an axis in close proximity to the platen so that the platen underlies the mold to facilitate drainage of water from the mold and the wet molded pulp product.

15. A method as in claim 13 wherein after the mold and the wet molded product have been withdrawn from the fiber slurry, a vacuum is supplied to the mold to facilitate the removal of water from the mold and the molded pulp product.

16. A method as in claim 15 wherein the water withdrawn from the mold and the molded product is collected for recycling.

17. A method as in claim 15 wherein any remaining moisture withdrawn from the mold and the molded pulp product is vented to atmosphere after the lapse of a predetermined time.

18. A method as in claim 13 wherein said mold is a first mating mold having a screen pattern and wherein there is provided a second mating mold having a screen pattern for mating with the first mold, the method further comprising the steps of advancing the first mold after it has been withdrawn from the fiber slurry into engagement with the second mold to mate with the second mold.

19. A method for producing molded pulp products from a fiber slurry having a liquid level with the use of a first mating mold and a second mating mold for mating with the first mating mold, the first mating mold being carried by a platen, the method comprising introducing the mold downwardly with the platen being disposed upwardly of the mold into the fiber slurry through the liquid level of the fiber slurry so that the mold is immersed in the fiber slurry, supplying a vacuum to the first mating mold to cause fibers from the fiber slurry to collect on the first mating mold to form a wet molded pulp product, withdrawing the first mating mold from the fiber slurry through the liquid level of the fiber slurry, permitting water to drain from the wet molded product, advancing the first mating mold after it has been withdrawn from the fiber slung into engagement with the second mating mold to mate with the second mating mold, drying the molded pulp product by use of a dry chamber with the second mating mold being disposed in the dry chamber, causing the first mating mold to mate with the second mating mold in the dry chamber to cause the wet molded pulp product to receive impressions from both the first and second molds, transferring the wet molded pulp product from the first mating mold to the second mating mold, withdrawing the first mating mold from the dry chamber, closing the dry chamber so that it is air tight and supplying heated air to the dry chamber to cause drying of the wet molded pulp product carried by the second mating mold.

20. A method as in claim 19 wherein the heated air can only pass from the dry chamber after passing through the molded product.

21. A method as in claim 19 further including the step of opening the dry chamber and separating the dry molded product from the second mold in the dry chamber and removing the separated dried molded pulp product.

22. A method as in claim 19 wherein during the time that the wet molded pulp product is being dried in the dry chamber on the second mold, the first mold is being moved to be reintroduced into the fiber slurry to cause another wet molded pulp product to be formed on the first mold to thereby expedite the production of molded product.

* * * * *